United States Patent [19]

Froment et al.

[11] Patent Number: 4,877,060

[45] Date of Patent: Oct. 31, 1989

[54] DEVICE FOR COUPLING HEDDLE FRAMES TO THE TRANSMISSION ELEMENTS OF A MECHANISM FOR FORMING THE SHED

[75] Inventors: Jean-Paul Froment, Doussard; Joseph Palau, Duingt, both of France

[73] Assignee: S.A. Des Establissements Staubli (France), Faverges, France

[21] Appl. No.: 205,839

[22] Filed: Jun. 13, 1988

[30] Foreign Application Priority Data

Jun. 26, 1987 [FR] France ..... 87 09275

[51] Int. Cl.[4] ..... D03C 13/00

[52] U.S. Cl. ..... 139/82; 139/88

[58] Field of Search ..... 139/82, 83, 84, 87, 139/88; 24/135 A, 136 R

[56] References Cited

U.S. PATENT DOCUMENTS 3,106,229 10/1963 Gebhardt ..... 139/82

4,644,979 2/1987 Senn et al. ..... 139/82

FOREIGN PATENT DOCUMENTS 2737936 2/1979 Fed. Rep. of Germany ..... 139/88

*Primary Examiner*—Henry S. Jaudon

*Attorney, Agent, or Firm*—Dowell & Dowell

[57] ABSTRACT

A device for coupling heddle frames to rod or cable transmission elements of a mechanism for forming the shed in a weaving loom wherein a female mortise member includes a slot having a pair of opposing arms on either side thereof which shot is traversed by the transmission elements which transmission elements pass through a male tenon member which is adjustably fixed thereto with the aid of a locking mechanism and which male tenon member interengages the female mortise member.

13 Claims, 5 Drawing Sheets

DEVICE FOR COUPLING HEDDLE FRAMES TO THE TRANSMISSION ELEMENTS OF A MECHANISM FOR FORMING THE SHED

BACKGROUND OF THE INVENTION

1. Field of the Invention

The present invention relates to dobbies and other mechanisms for forming the shed in weaving looms, and more particularly to the coupling of the heddle frames on the cables or other transmission elements intended for maneuvering them.

2. History of the Related Art

It is know that, in mechanisms associated with a drawing system of the negative type one of the ends of each of the maneuvering cables is generally secured to one of the swinging drawing levers of the mechanism while the opposite end is connected, through a pivoting sector to a set of springs adapted to return the corresponding heddle frame to the rest position after it has been positively displaced by mechanism. Between its two points of fixation, the cable is guided by a lower detour pulley, presents a segment oriented substantially vertically, which follows along the upright of the frame.

In certain cases, each heddle frame is suspended from its two lateral pivoting sectors by means of articulated rods, but in other applications, it is the upright of the frame which is fixed to the vertical segment of the cable, without any articulation, in the manner illustrated in FIG. 1. The present invention refers to this latter mode of assembly.

Experience has shown that the operations of assembly and dismantling of the heddle frames are difficult. The uprights of each frame are generally fixed to the cables by mechanisms incorporating collars or screwed flanges which are difficult to manoeuvre. Assembly systems have been proposed which employ male and female members in the form of tenon and mortise, but the structural solutions adopted still remain relatively complex to carry out and their reliability is mediocre.

SUMMARY OF THE INVENTION

It is a principle object of the present invention to overcome the aforementioned drawbacks, by providing, in an assembly incorporating members in the form of tenon and mortise which are secured, some with the cable, the others with the uprights of the frame in order to be opposite along the same substantially vertical plane. The members which are slit parallel to the plane of the frame form, on either side of the cable, contact surfaces between the tenons and the mortises for transmission of efforts or forces.

It will be readily appreciated that such a structure avoids non-alignment of the lines of force and the surfaces of application of these forces in the coupling system, with the result that the two combined tenon and mortise members do not require any reciprocal fixation. The fit with reduced clearance between the tenon and mortise members is sufficient to alone ensure the transmission of the drawing efforts or forces developed.

BRIEF DESCRIPTION OF THE DRAWINGS

The invention will be more readily understood on reading the following description with reference to the accompanying drawings, in which.

As indicated in the preamble.

DESCRIPTION OF THE PREFERRED EMBODIMENT

Figure 1:
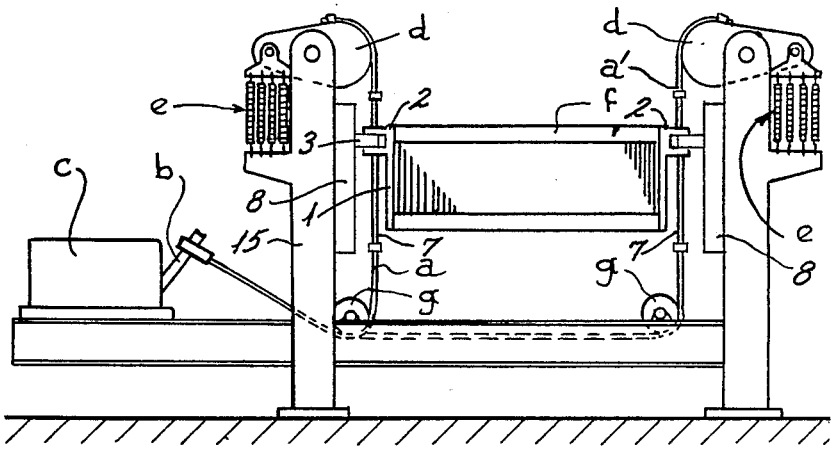
FIG. 1 is a view in elevation schematically illustrating the arrangement of the invention associated with a drawing system of the negative type.

Referring again to the drawings, in FIGS. 1 to 5, one of the cables a is secured at one end around a pulley g to a swinging drawing lever b of operating mechanism c and at the other end to a vertical rod or motion transmission element 7. The other cable a' is secured at one end to a member d which is pivotally mounted to frame member 15 and is acted on by a set of springs e and is joined at the other end to the vertical rod 7. The springs e act through the cable a' and rod 7 to return the heddle frame f to a rest position after the frame has been positively displaced by operation of the operating mechanism c. Reference 1 designates one of the two uprights of heddle frame. Against this upright 1 has been added a fork element 2 of which the opening 2*a* is oriented horizontally towards the outside of the frame. This opening 2*a* defines two superposed arms, each of these arms having a vertical slot 2*b* cut out therein, of which the bottom is semi-cylindrical in cross-section.

It will be understood that this fork element 2 constitutes a female member in the form of mortise, adapted to receive in its opening 2*a* a tenon formed by the end 3*a* of a male member 3, having a vertical housing 3*b* open at its two ends and being hollowed out therein. In this housing 3*b* are mounted a jaw 4 and two pusher elements 5 connected to each other by a locking screw 6. As shown more clearly in FIG. 4, the jaw 4 presents, opposite a vertical bearing face 4*a* of semi-cylindrical section, two opposite oblique faces 4*b* which are adapted to cooperate with a ramp 5*a* provided on the side of each pusher element 5.

One of the pusher elements 5 has a vertical bore 5*b* hollowed therein, traversed by the screw 6 which cooperates with a similar vertical tapping 5*b* in the second pusher element, with the result that, by manoeuvring the screw 6, the pusher elements are brought closer together and they tend to drive the jaw 4 horizontally inside the housing 3*b*.

This housing 3*b* is traversed by a vertical rod or motion transmission element 7 which, in manner known per se in the systems of the negative type for drawing the heddle frames, interrupts at the level of the coupling device the cable secured to one of the levers of the dobby or other like mechanism, the ends of the rod 7 being crimped on the two ends of the cable envisaged.

It will be appreciated that, if this rod 7 is inserted between the bottom of the housing 3*b* and the bearing face 4*a* of the jaw 4, the manoeuvre of the screw 6 ensures axial and lateral blockage of the rod against the tenon-shaped member 3, while allowing precise adjustment of this member with respect to the opening of the fork element 2.

Figure 2:
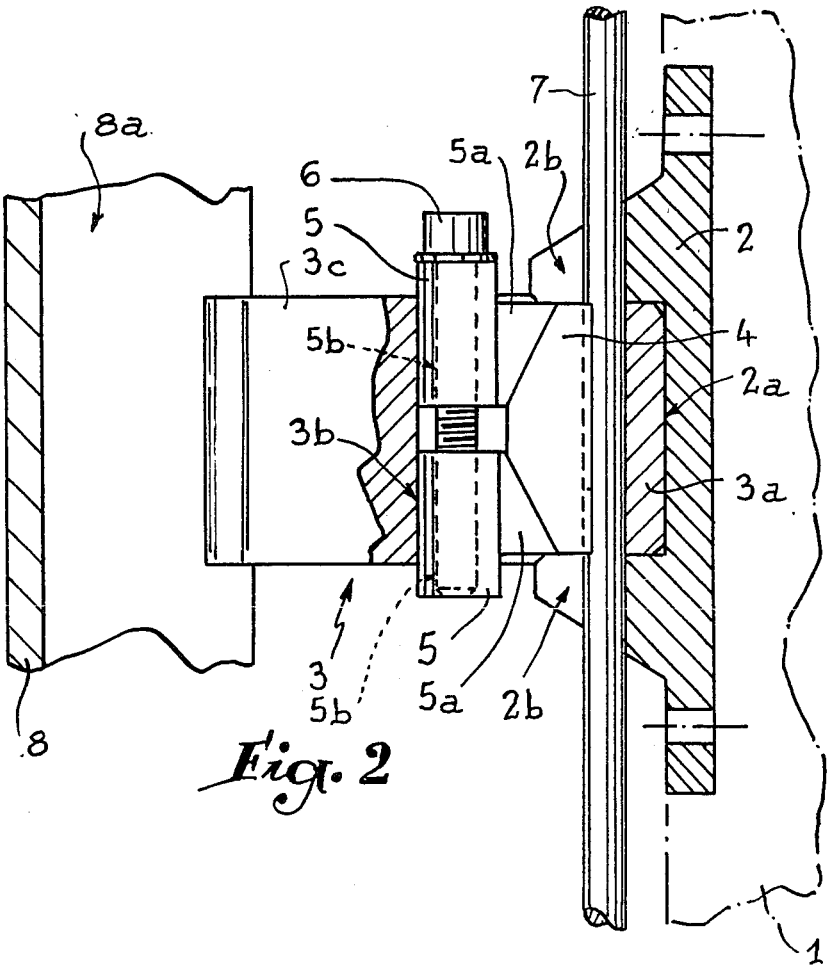
FIG. 2 is a vertical section through a coupling device according to the invention.
Figure 3:
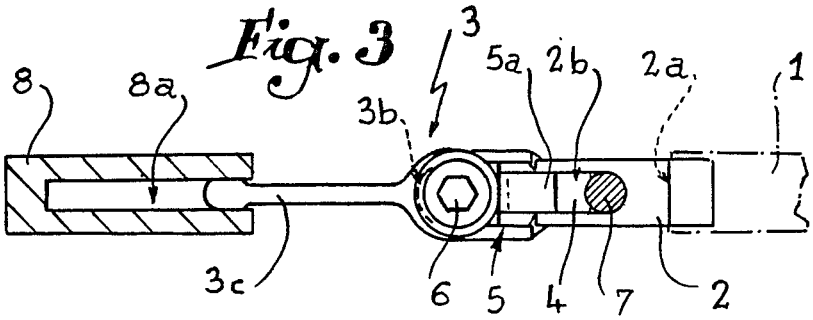
FIG. 3 is a horizontal section of the coupling device of FIG. 2.
Figure 4:
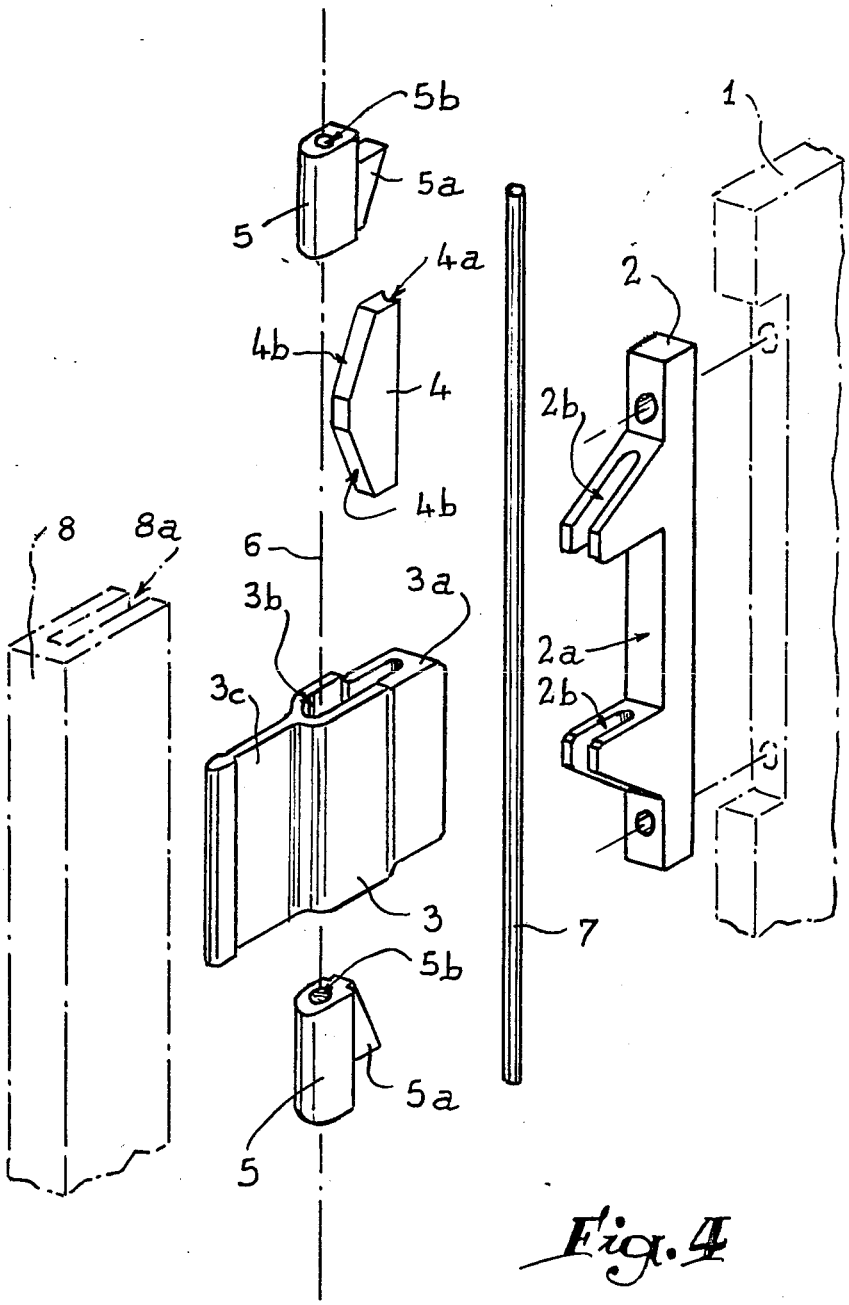
FIG. 4 shows in perspective, prior to assembly thereof, the different elements of the device of FIGS. 2 and 3.

It will be observed that the radius of the bottom of the two slots 2*b* of the fork element, the radius of the bottom of the housing 3*b* which faces the direction of the end 3*a* of the male member 3, and the radius of the bearing face 4*a* of the jaw 4 are substantially equal, to within a very slight clearance, to the radius of rod 7, as is clearly apparent in FIGS. 2 and 3. Furthermore, the horizontal edges of the opening 2*a* of the fork element 2 are oriented in strictly parallel manner and their spaced apart relationship is equal, to within a very slight clearance, to the height of the end 3*a* of the male member 3.

Under these conditions, the end 3*a* engages closely inside the opening 2*a*, virtually without clearance. The rod 7 is perfectly applied in the bottom of the slots 2*b* that it traverses vertically, so that a precise and stable fit is obtained, in which the effort or force transmitted passes substantially through the centre of the surfaces in contact, which contact surfaces, shown in FIG. 5 by hachuring, are disposed on either side of the axis of rod 7. Consequently, any creation of rocking moment is avoided, so that a mutual fixation of the members 2 and 3 with the aid of screws or other separate pieces can be dispensed with, whatever the amount of the effort to be developed for the vertical manoeuvre of the heddle frame shown.

Figure 6:
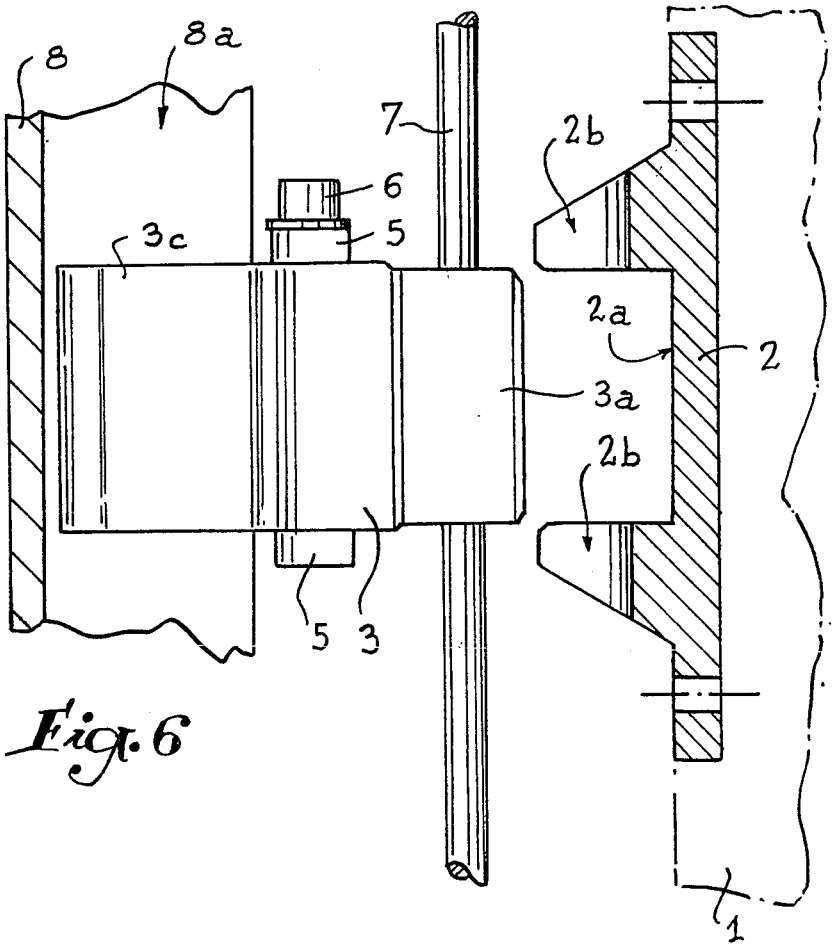
FIGS. 6 and 7 are sections identical to those of FIG. 2 and FIG. 3 respectively, the member in the form of tenon having been shown after withdrawal from the member in the form of mortise.
Figure 7:
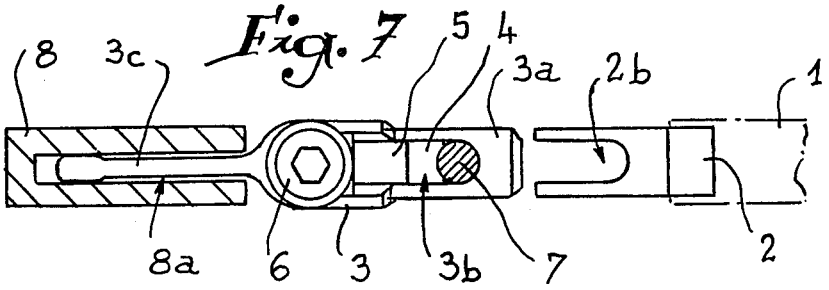

With a view to avoiding any lateral displacement of the male member 3 in the course of operation of the weaving loom, this member is provided, opposite end 3*a*, with a heel 3*c* of which the tail is engaged with reduced clearance inside the opening 8*a* of a vertical U-sectioned slide 8 permanently fixed against the structure of the loom 15 on each of the sides of the heddle frames thereof. This slide 8 is positioned so as not to hinder assembly and dismantling of the heddle frames on the rods 7, these operations being effected by outwardly displacing the cables which support the rods, in the manner illustrated in FIGS. 6 and 7. These operations are, of course, simplified as they require no manoeuvre of screws or other securing member at each coupling device.

Figure 8:
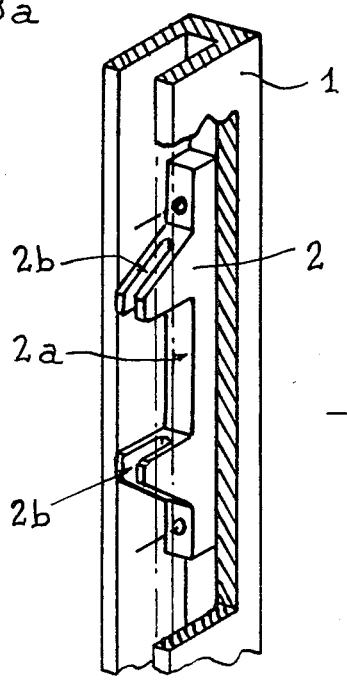
Figure 5:
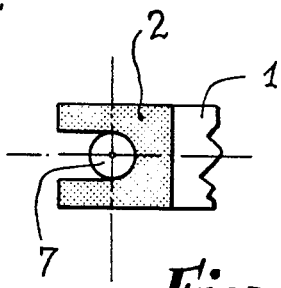
FIG. 5 is a transverse section showing the conditions of transmission of the efforts or forces between the two members of the device.

The device according to the invention makes it possible considerably to reduce the overhang existing between each of the uprights 1 of the heddle frame and the axis of the cable which ensures displacement thereof. This overhang may further be reduced to its minimum value by adopting the variant embodiment illustrated in FIG. 8, in which each upright 1 is constituted by a C-sectioned piece against the web or bottom of which is fixed the fork element 2, so that the rod 7 itself is housed inside the C-shaped piece or upright.

Figure 9:
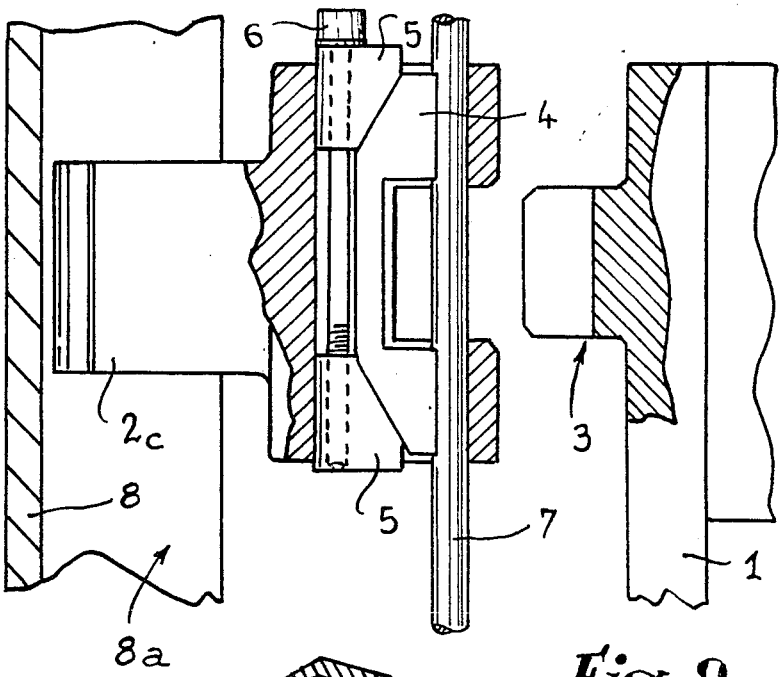
FIGS. 8 and 9 show two variant embodiments of the invention.

In addition, it will be understood (cf. FIG. 9) that the above described arranged may be reversed by fixing the fork element 2, equipped with a heel 2*c* introduced in the slide 8 and with a jaw mechanism 4-5-6, against the rod 7 in order to cooperate with a male member 3 secured with the upright 1 of the heddle frame. It goes without saying that, in such a case, the jaw 4 presents the form of a stirrup to allow the male member 3 to penetrate into the opening 2*a*, which member is itself slit vertically to embrace the rod 7, as illustrated in FIG. 9.

It must, moreover, be understood that the foregoing description has been given only by way of example and that it in no way limits the domain of the invention which would not be exceeded by replacing the details of execution described by any other equivalents. In particular, in certain cases, it is possible to dispense with the rod 7, the jaw mechanism 4-5-6 ensuring direct fixation of the female member 2 or the male member 3 against the drawing cable or other motion transmission element which ensures manoeuvre of the heddle frame in question.

Figure 10:
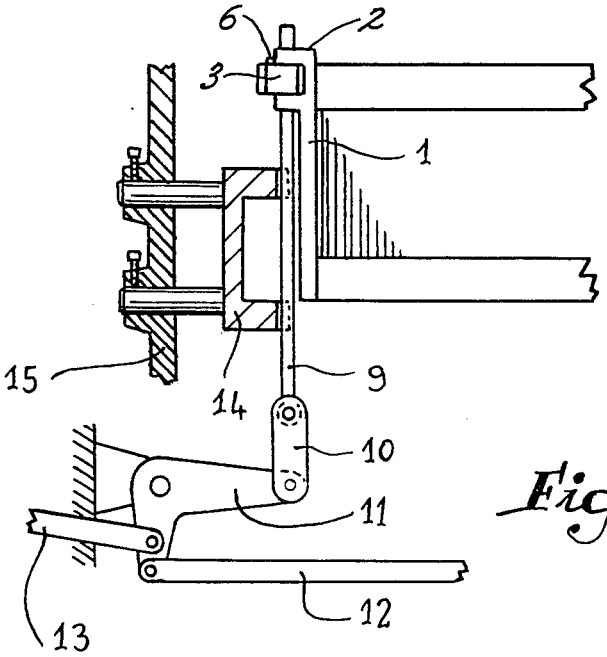
FIG. 10 schematically illustrates the application of the invention to a drawing system of the positive type.

It should also be observed that the invention is applicable to drawing systems of the positive type in which the frames are controlled positively in both directions. As illustrated in FIG. 10, each transmission element is here formed, no longer by a cable, but by a rod 9 of polygonal section whose lower end is coupled by a rod 10 to a lever 11 which is itself connected by a rod 12 to the other lever 11 and by a rod 13 to the corresponding swinging drawing lever of the mechanism . Each rod 9 is therefore comparable to rod 7 of the preceding embodiments; its correct angular orientation is ensured by a vertical guide 14 which is fixed to the structure 15 of the loom by a mechanism which allows recoil of the guide 14 and the rod 9 with a view to the operations of assembly and disconnection of the male and female members of the coupling device associated with each upright 1 of the frame shown.

What is claimed is:

1. A coupling device for connecting the uprights of a heddle frame to a motion transmission element in a weaving loom wherein the uprights are disposed along a plane and the motion transmission element includes an elongated axis comprising, a male tenon member and a female mortise member, one of said members being connected to the upright of the heddle frame and the other of said members being connected to the motion transmission element, said one of said members including an open slot along the plane of the upright to form at least one pair of opposing and outwardly extending arm elements, said other of said members being selectively seated between said arm elements so that the axis of the motion transmission element passes through said slot and intermediate said arm elements whereby forces distributed along the axis of the motion transmission element are distributed to said members to thereby prevent shifting of said said members with respect to one another.

2. The coupling device of claim 1 in which said other member is adjustably secured to the motion transmission element so as to be re-oriented along the access thereof.

3. The coupling device of claim 1 wherein said other member includes a housing portion having an opening therethrough, a jaw means disposed within said opening, a pair of pusher elements disposed within said opening, the motion transfer element passing through said opening, said jaw means having opposing faces, one of said faces engaging the motion transmission element, said pusher elements being cooperatively engagable with said jaw means, and adjustment means for urging said pusher elements into contact with said jaw means to thereby urge said one face of said jaw means against said motion transmission element.

4. The coupling device of claim 3 wherin said jaw means includes a pair of oblique faces opposite said one of said faces, and each of said pusher elements including inclined ramps which are engagable with said oblique faces of said jaw means as said pusher elements are urged toward one another.

5. The coupling device of claim 4 in which said one face of said jaw means includes a bearing surface which is complimentary in shape to the motion transmission element.

6. The coupling device of claim 3 in which said other member includes a heel portion extending from said housing oppositely with respect to said one of said members, a slide member having an elongated opening therein, said heel portion being guidingly received within said elongated opening of said slide member.

7. The coupling device of claim 6 in which said jaw means includes a pair of oblique faces opposite said one of said faces, and each of said pusher elements includes inclined ramps which are engagable with said oblique faces of said jaw means as said pusher elements are urged toward one another.

8. The coupling device of claim 6 in which the upright includes a recessed channel, and said one of said members being mounted within said channel.

9. The coupling device of claim 3 in which said slot in said one member includes a bottom portion having a configuration complimentary to the motion transmission element, said motion transmission element engaging said bottom portion when the other member is seated with respect to said one member.

10. The coupling device of claim 9 wherein said one member includes two vertically spaced pairs of opposing and outwardly extending arm elements, said other of said members being seated between said pairs of arm elements.

11. The coupling device of claim 9 in which said other element includes a heel portion extending from said housing oppositely with respect to said one of said members, a slide member having an enlarged opening therein, said heel portion being slidingly receivable within said elongated opening of said slide member.

12. The coupling device of claim 1 including guide means, means for connecting the guide means to the weaving loom, said guide means including guide portions which are aligned relative to the axis of the motion transmission element, and the motion transmission element extending through said guide portions.

13. The coupling device of claim 1 wherein the motion transmission element includes a rigid rod having ends, a cable adjacent each of said ends, and said ends being crimped to said cable.

* * * * *